US006916113B2

(12) United States Patent
Van de Goor et al.

(10) Patent No.: US 6,916,113 B2
(45) Date of Patent: Jul. 12, 2005

(54) DEVICES AND METHODS FOR FLUID MIXING

(75) Inventors: Tom Van de Goor, Foster City, CA (US); Reid A. Brennen, San Francisco, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 234 days.

(21) Appl. No.: 10/439,864

(22) Filed: May 16, 2003

(65) Prior Publication Data

US 2004/0228212 A1 Nov. 18, 2004

(51) Int. Cl.[7] ..... B01F 11/00

(52) U.S. Cl. ..... 366/108; 366/208; 366/332; 366/348; 366/349; 366/DIG. 3

(58) Field of Search ..... 366/332–334, 366/341, 108, 114, 116, 208, 212, 219, 255, 240, 262, 256, 349, 348, DIG. 3; 435/288.3, 288.5; 422/68.1, 99; 138/46

(56) References Cited

U.S. PATENT DOCUMENTS 3,182,967 A * 5/1965 Krahe ..... 366/343
4,483,621 A * 11/1984 Kreiskorte ..... 366/114
4,869,282 A 9/1989 Sittler et al.
5,291,226 A 3/1994 Schantz et al.
5,305,015 A 4/1994 Schantz et al.
5,333,831 A 8/1994 Barth et al.
5,368,704 A 11/1994 Madou et al.
5,417,235 A 5/1995 Wise et al.
5,500,071 A 3/1996 Kaltenbach et al.
5,571,410 A 11/1996 Swedberg et al.
5,645,702 A 7/1997 Witt et al.
5,725,017 A 3/1998 Elsberry et al.
5,771,902 A 6/1998 Lee et al.
5,819,794 A 10/1998 Anderson
5,921,678 A 7/1999 Desai et al.
5,927,325 A 7/1999 Bensaoula et al.
5,964,239 A 10/1999 Loux et al.
6,065,864 A 5/2000 Evans et al.
6,082,891 A 7/2000 Schubert et al.
6,102,068 A 8/2000 Higdon et al.
6,146,103 A 11/2000 Lee et al.
6,264,900 B1 7/2001 Schubert et al.
6,331,072 B1 12/2001 Schierholz et al.
6,331,073 B1 12/2001 Chung
6,550,497 B2 * 4/2003 Thiele et al. ..... 137/625.46
2001/0048900 A1 12/2001 Bardell et al.
2002/0057627 A1 5/2002 Schubert et al.
2002/0125134 A1 9/2002 Santiago et al.
2003/0015682 A1 1/2003 Killeen et al.
2003/0017609 A1 1/2003 Yin et al.
2003/0159993 A1 * 8/2003 Yin et al. ..... 210/656

OTHER PUBLICATIONS

Böhm et al. (2001), "A Rapid Vortex Micromixer for Studying High–Speed Chemical Reactions," *Proc. Micro Total Analysis Systems 2001* (*μTAS 2001 Symposium*), pp. 25–27, Monterey, USA.

(Continued)

*Primary Examiner*—Tony G. Soohoo

(57) ABSTRACT

A device for mixing fluids is provided. The device is comprised of a substrate containing a first mixing feature that terminates at a first opening located on a surface of the substrate and a cover plate containing a second mixing feature that terminates at a second opening located on a surface of the cover plate. Also provided is a means for producing relative sliding motion between the cover plate and substrate surfaces. The substrate and cover plate surfaces are maintained in fluid-tight contact with each other such that relative sliding motion between the first and second mixing features induces fluid mixing through the first and second openings when fluid is present in the mixing features. Also provided is a method for mixing fluids. The device and method are particularly suited for microfluidic applications.

24 Claims, 11 Drawing Sheets

OTHER PUBLICATIONS

Branebjerg et al. (1996), "Fast Mixing by Lamination," *Proc. MEMS–96*, pp. 441–446, San Diego, USA.

Hong et al. (2001), "A Novel In–Plane Passive Micromixer Using Coanda Effect," *Proc. Micro Total Analysis Systems 2001* (*μTAS 2001 Symposium*), pp. 31–33, Monterey. USA.

Liu et al. (2001). "Plastic In–Line Chaotic Micromixer for Biological Applications," *Proc. Micro Total Analysis Systems 2001* (*μTAS 2001 Symposium*), pp. 163–164, Monterey, USA.

Miyake et al. (1993). "Micro Mixer with Fast Diffusion," *Proc. MEMS–93*, pp. 248–253, Fort Lauderdale, USA.

Oddy et al. (2000), "Electrokinetic Instability Micromixers." *Proc. Micro Total Analysis Systems 2001* (*μTAS 2001 Symposium*), pp. 34–36.

Stremler et al. (2000), "Chaotic Mixing in Microfluidic Systems," *Tech. Digest of Solid–State Sensor and Actuator Workshop*, pp. 187–190. Hilton Head Island. USA.

Woias et al. (2000), "An Active Silicon Micromixer for μTAS Applications," *Proc. Micro Total Analysis Systems 2000* (*μTAS 2000 Symposium*), pp. 277–282, Enschede, The Netherlands.

Yasuda (2000), "Non–Destructive Mixing, Concentration, Fractionation and Separation of μm–Sized Particles in Liquid by Ultrasound," *Proc. Micro Total Analysis Systems 2000* (*μTAS 2000 Symposium*), pp. 343–346, Enschede, The Netherlands.

* cited by examiner

DEVICES AND METHODS FOR FLUID MIXING

TECHNICAL FIELD

The present invention generally relates to devices and methods for mixing fluids. More specifically, the invention relates to devices and methods that use relative sliding motion between mixing features of a cover plate and a substrate to mix fluids within the mixing features. The invention is particularly suited for microfluidic applications and for mixing small volumes of fluids.

BACKGROUND

Microfluidic devices (microdevices) hold great promise for many fields of use, including chemical analysis or clinical diagnostics. The small size of microdevices allows for the analysis of minute quantities of fluids or samples, which is an important advantage when the fluids or samples are expensive or difficult to obtain. To enhance the functionality of sample analysis devices, it has been proposed that preparation, separation and detection compartments be integrated on such devices. Microfluidic technologies are generally described, for example, in U.S. Pat. Nos. 5,500,071 to Kaltenbach et al., U.S. Pat. No. 5,571,410 to Swedberg et al., and U.S. Pat. No. 5,645,702 to Witt et al.

Since many microfabricated devices have a relatively simple construction, they are in theory inexpensive to manufacture. Nevertheless, the production of such devices presents various challenges. For example, the flow characteristics of fluids in the small flow channels of a microfabricated device may differ from the flow characteristics of fluids in larger devices, as surface effects come to predominate and regions of bulk flow become proportionately smaller. In particular, the implementation of fluid flow control and fluid mixing in microdevices presents unique challenges.

With respect to fluid flow control, for example, conventional wisdom dictates that valve structures, which control flow of fluids in bulk, are not easily adaptable for use in microfluidic devices due to the predominance of surface effects. Accordingly, various patents describe valve technologies for use in microdevices. See, e.g., U.S. Pat. Nos. 4,869,282 to Sittler et al., U.S. Pat. No. 5,333,831 to Barth et al., U.S. Pat. No. 5,368,704 to Madou et al., U.S. Pat. No. 5,417,235 Wise et al., U.S. Pat. No. 5,725,017 to Elsberry et al., U.S. Pat. No. 5,771,902 to Lee et al., U.S. Pat. No. 5,819,794 to Anderson, U.S. Pat. No. 5,927,325 to Bensaoula et al., U.S. Pat. No. 5,964,239 to Loux et al., and U.S. Pat. No. 6,102,068 to Higdon et al. Many of these valve technologies, however, are complex in construction and are incapable of the fast response times required in certain biomolecule analysis applications due to an excess of "dead space," i.e., unused and unnecessary space within the microdevice.

A simplified valve structure for controlling fluid flow has been proposed in U.S. Patent Application Publication No. 2003/0015682 to Killeen et al. This published application describes a microdevice comprising a substrate and a cover plate, each having a substantially planar contact surface and a fluid-transporting feature associated therewith. The substrate contact surface is positioned in slidable and fluid-tight contact with the cover plate contact surface to allow for controllable alignment between the fluid-transporting features. As a result, fluid communication is provided between the fluid-transporting features through a sliding and/or rotational motion. In addition, the microdevice may be used to form controllable and/or alignment-dependent variable-length flow paths. The simplified valve structure may be used in microdevices for component separation such as those described in U.S. Patent Application Publication No. 2003/0017609 to Yin et al.

With respect to fluid-mixing technologies in the context of microdevices, they may be categorized as active or passive. Active techniques typically involve use of an exogenous mechanism to effect fluid mixing by introducing local disturbances or instabilities in fluids. For example localized disturbances or instabilities may be introduced via cavitation action through the use of ultrasonic mixing (see Yasuda (2000), "Non-Destructive Mixing, Concentration, Fractionation and Separation of μm-sized Particles in Liquid by Ultrasound," *Proc. Micro Total Analysis Systems* 2000 (*μTAS* 2000 *Symposium*), Enschede, The Netherlands, 14–18 May 2000, pp.343–346). Other examples of active mixing techniques include, but are not limited to, order-changing micromixing techniques (see U.S. Pat. No. 6,331,073 to Chung), magnetohydrodynamic-driven mixing (see U.S. Pat. No. 6,146,103 to Lee et al.), electrokinetic mixing (see Branebjerg, et al. (1996), "Fast Mixing by Lamination," *Proc. MEMS*-96, San Diego, USA, Feb. 11–15, 1996, pp. 441–446 and U.S. Patent Application Publication No. 2002/0125134 to Santiago et al.), active flow disturbance (see Woias et al. (2000), "An Active Silicon Micromixer for μTAS Applications," *Proc. Micro Total Analysis Systems* 2000 (*μTAS* 2000 *Symposium*), Enschede, The Netherlands, 14–18 May 2000, pp.277–282), and bubble-pulsed double-dipole flow field mixing (see U.S. Pat. No. 6,065,864 to Evans et al.).

Passive techniques, on the other hand, typically rely more on diffusion and laminar flow streams to effect mixing. Examples of passive mixers include, but are not limited to, simple diffusion (see, e.g., U.S. patent application Ser. No. 10/085,598, entitled "Mobile Phase Gradient Generation Microfluidic Device, filed Feb. 26, 2002, inventors Yin, Killeen, and Sobek), lamination diffusion (see Branebjerg et al, "Fast Mixing by Lamination," *Proc. MEMS*-96, San Diego, USA, Feb. 11–15, 1996, pp. 441–446; U.S. Patent Application Publication No. 2002/0057627 to Schubert et al.; U.S. Pat. No. 6,264,900 to Schubert et al.; U.S. Pat. No. 6,082,891 Schubert et al.; and U.S. Pat. No. 5,921,678 Desai et al.), plume injection (see Miyake et al. (1993), "Micro Mixer with Fast Diffusion," *Proc. MEMS*-93, Fort Lauderdale, USA, Feb. 7–10, 1993, pp. 248–253, chaotic mixing (see Stremler et al. (2000), "Chaotic Mixing in Microfluidic Systems," *Tech. Digest of Solid-State Sensor and Actuator Workshop*, Hilton Head Island, USA, Jun. 4–8, 2000, pp. 187–190; Liu et al. (2001), "Plastic In-line Chaotic Micromixer for Biological Applications," *Proc. Micro Total Analysis Systems* 2001 (*μTAS* 2001 *Symposium*), Monterey, USA, 21–25 Oct. 2001, pp. 163–164; and U.S. Pat. No. 6,331,072 to Schierholz et al.), "Coanda" effect mixing (see Hong et al. (2001), "A Novel In-plane Passive Micromixer Using Coanda Effect," *Proc. Micro Total Analysis Systems* 2001 (μTAS 2001 *Symposium*), Monterey, USA, 21–25 Oct. 2001, pp.31–33), and vortex mixing (see Böhm (2001), "A Rapid Vortex Micromixer for Studying High-Speed Chemical Reactions," *Proc. Micro Total Analysis Systems* 2001 (*μTAS* 2001 *Symposium*), Monterey, USA, 21–25 Oct. 2001, pp. 25–27; and U.S. Application Patent Publication No. 2001/0048900 to Bardell et al.).

The mixing techniques discussed above suffer from a number of drawbacks. Like the conventional valve technology described above, the active mixing technologies are usually complex in construction. In addition, both active and passive mixing technologies ordinarily require dedicated regions within a microdevice, which tends to increase the size and complexity of the microdevice. For example, high-throughput microfluidic applications may require use of dedicated channels in a microdevice when passive mixing is used so as to provide for the sufficiently high diffusion rates needed to carry out the high-throughput applications.

Thus, akin to the need for improved and simplified fluid control technology in the microfluidic arts, there is a corresponding need for an improved and simplified mixing structure. The invention overcomes the above-mentioned disadvantages of the prior art by providing such improved mixing devices and methods, which are adaptable for use with microdevice technologies, particularly those that employ valve assembly technologies such as those described in U.S. Patent Application Publication Nos. 2003/0015682 to Killeen et al. and 2003/0017609 Yin et al.

SUMMARY OF THE INVENTION

One aspect of the invention relates to a device for mixing fluids, comprising a substrate containing a first mixing feature that terminates at a first opening located on a surface of the substrate and a cover plate containing a second mixing feature that terminates at a second opening located on a surface of the cover plate. Also provided is a means for producing relative sliding motion between the cover plate and substrate surfaces. The substrate and cover plate surfaces are maintained in fluid-tight contact with each other such that relative sliding motion between the first and second mixing features induces fluid mixing through the first and second openings when fluid is present in the mixing features. Typically, the cover plate and substrate surfaces are substantially planar.

The mixing features may be constructed depending on the manner in which the device is to be used. The first and second openings may be substantially identical in size and/or shape. In some instances, at least one opening has a nonoverlapping portion with respect to the other opening. In addition, at least one mixing feature may have a bottom profile effective to generate a plurality of vortices within the feature when relative sliding motion is produced between the cover plate and substrate surfaces. Optionally, a flow disturbance feature may be provided within at least one mixing feature. When the flow disturbance feature is an integral part of the substrate or cover plate of the mixing feature in which the flow disturbance feature is located, the flow disturbance feature typically does not extend past the opening of the mixing feature in which the flow disturbance feature is located. However, fluid disturbance features that extend past the opening may be advantageously employed as well.

Similarly, the means for producing relative sliding motion may be constructed according to the manner in which the device is to be used. For example, relative rotational movement and/or linear movement may be produced between the surfaces of the substrate and cover plate. In addition, periodic motion between the substrate and cover plate surfaces may be produced as well. Typically, the periodic motion has a frequency of at least about 0.10 Hz and no greater than 1000 Hz. Preferably, the frequency is about 1 Hz to about 100 Hz. The periodic motion may be asymmetric or symmetric.

The invention is particularly suited for microfluidic applications. Thus, the invention also provides a microdevice for mixing fluids. The device includes a substrate containing a first mixing feature that terminates at a first opening on a surface of the substrate and a cover plate containing a second mixing feature that terminates at a second opening on a surface of the cover plate. The first mixing feature is in fluid communication with a substrate inlet and an optional substrate outlet, and the second mixing feature is in fluid communication with a cover plate inlet and a cover plate outlet. Also provided is a means for producing relative sliding motion between the substrate and cover plate surfaces. The substrate and cover plate surfaces are maintained in fluid-tight contact with each other such that relative sliding motion between the first and second mixing features induces fluid mixing through the first and second feature openings when fluid is present in the mixing features. Typically, at least one mixing feature has a volume less than or equal to about 100 $\mu$L, optionally of a volume of at least about 1 pL.

Another aspect of the invention pertains to a method for mixing fluids. The method involves: (a) filling a first mixing feature in a substrate with a first fluid, wherein the first mixing feature terminates at a first opening on a substrate surface; (b) filling a second mixing feature in a cover plate with a second fluid, wherein the second feature terminates at a second opening on a cover plate surface; and (c) producing relative sliding motion between the substrate and cover plate surfaces while maintaining the surfaces in fluid-tight contact with each other to induce mixing of the first and second fluids through the first and second openings.

BRIEF DESCRIPTION OF THE DRAWINGS

FIG. 1A illustrates the microdevice in exploded view. FIG. 1B illustrates, in schematic cross-sectional view, the microdevice in a configuration for filling the mixing features of the microdevice. FIGS. 1C and 1D illustrate schematic cross-sectional views of the microdevice engaged in mixing motion.

FIG. 2A illustrates the microdevice in top through view. FIG. 2B illustrates the microdevice in cross-sectional view.

FIG. 3A depicts a device having mixing features with a round bottom profile, while FIG. 3B depicts a curved bottom profile, and FIG. 3C depicts mixing features shaped to create a plurality of vortices at specific locations.

FIG. 4A depicts a device in which the terminal openings are identical in size and shape, and are aligned with each other. FIG. 4B depicts terminal openings that are identical in size and shape, but are offset from each other. FIG. 4C depicts terminal openings that are different in size and shape, but are aligned with each other. FIG. 4D depicts terminal openings that are different in size and shape, and are offset from each other. FIG. 4E depicts terminal openings that are identical in shape but are oriented differently such that only a portion of each opening may overlap each other at any given time. FIG. 4 depicts a variation of the device depicted in FIG. 4E, wherein the area of overlap changes depending on the relative position of the openings.

FIG. 6A illustrates the microdevice in exploded view. FIGS. 6B–6F illustrate, in top through view, various configurations associated with the microdevice.

DETAILED DESCRIPTION OF THE INVENTION

Figure 1A:
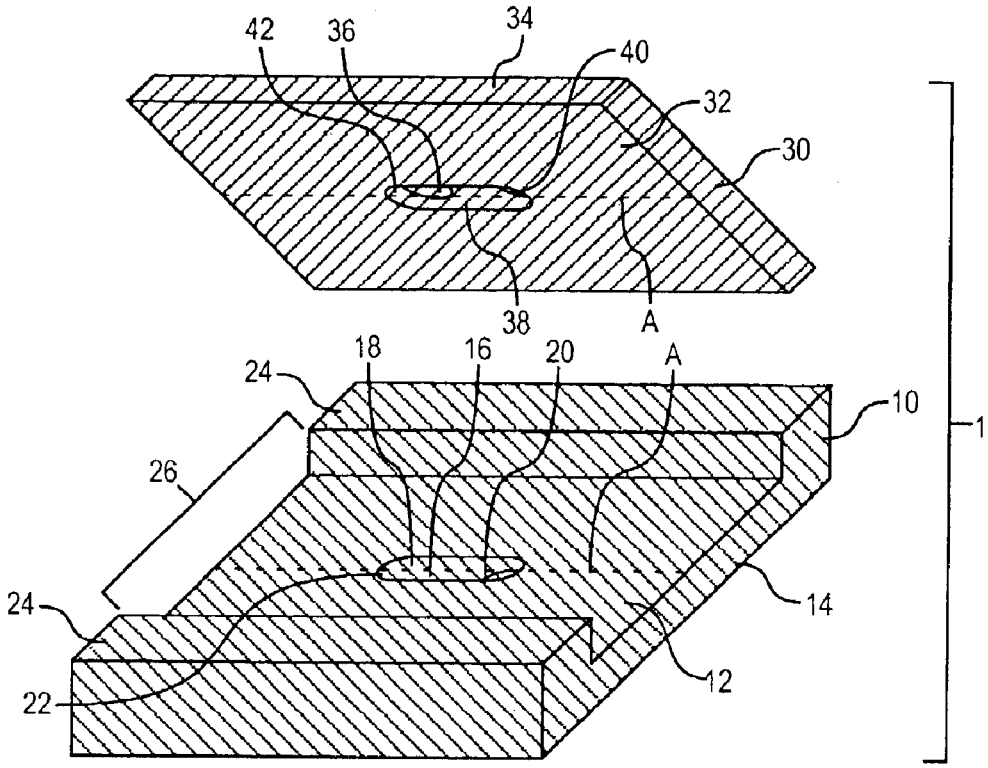
FIGS. 1A–1D, collectively referred to as FIG. 1, schematically illustrate an exemplary inventive microdevice that employs linear motion for mixing fluids.

Before the invention is described in detail, it is to be understood that, unless otherwise indicated, this invention is not limited to particular materials, components or manufacturing processes, as such may vary. It is also to be understood that the terminology used herein is for purposes of describing particular embodiments only, and is not intended to be limiting.

As used in the specification and the appended claims, the singular forms "a," "an" and "the" include plural referents unless the context clearly dictates otherwise. Thus, for example, reference to "a mixing feature" includes a single mixing feature as well as a plurality of mixing features, reference to "an inlet" includes a single inlet as well as multiple inlets, reference to "a fluid" includes a single fluid as well as mixture of fluids, and the like.

In this specification and in the claims that follow, reference will be made to a number of terms that shall be defined to have the following meanings, unless the context in which they are employed clearly indicates otherwise:

The term "conduit" as used herein refers to a three-dimensional enclosure through which fluid may be transported, and is formed by one or more walls and that extends from a first terminal opening to a second terminal opening. The term "channel" is used herein to refer to an open groove or a trench in a surface. A channel in combination with a solid piece over the channel forms a conduit.

The term "flow disturbance feature" as used herein refers to an arrangement of solid bodies or portions thereof that alter fluid flow behavior within a mixing feature. Typically, though not necessarily, flow disturbance features are employed to enhance or facilitate mixing by introducing local disturbances or instabilities within a fluid in the mixing feature.

The term "fluid-tight" is used herein to describe the spatial relationship between two solid surfaces in physical contact such that fluid is prevented from flowing into the interface between the surfaces. In some instances, two surfaces in fluid-tight relationship may be placed in "slidable contact" with each other. In such a case, the two surfaces are in contact with reach other, but the relative position of surfaces may be altered without physically separating the two surfaces.

The term "microdevice" refers to a device having features of micron or submicron dimensions, and which can be used in any number of chemical processes involving very small amounts of fluid. Such processes include, but are not limited to, electrophoresis (e.g., capillary electrophoresis or CE), chromatography (e.g., $\mu$LC), screening and diagnostics (using, e.g., hybridization or other binding means), and chemical and biochemical synthesis (e.g., DNA amplification as may be conducted using the polymerase chain reaction, or "PCR") and analysis (e.g., through peptidic digestion). The features of the microdevices are adapted to the particular use. For example, microdevices that are used in separation processes, e.g., CE, contain microchannels (termed "microconduits" herein when enclosed, i.e., when the cover plate is in place on the microchannel-containing substrate surface) on the order of 1 $\mu$m to 200 $\mu$m in diameter, typically 10 $\mu$m to 75 $\mu$m in diameter, when the cross sectional shape of the microconduit is circular, and approximately 0.1 to 50 cm in length. Other cross-sectional shapes, e.g., rectangular, square, triangular, pentagonal, hexagonal, etc., having dimensions similar to above may be employed as well. Microdevices that are used in chemical and biochemical synthesis, e.g., DNA amplification, will generally contain reaction zones (termed "reaction chambers" herein when enclosed, i.e., again, when the cover plate is in place on the microchannel-containing substrate surface) having a volume of about 1 pl to about 100 $\mu$l, typically about 1 nl to about 20 $\mu$l, more typically about 10 nl to about 1 $\mu$l.

The term "mixing feature" as used herein refers to an arrangement of solid bodies or portions thereof to form a cavity within a solid item that terminates at an opening on a surface of the item. Typically, though not necessarily, mixing features are employed in facing pairs, and relative motion occurs between the feature openings mixing so as to produce fluid mixing through the feature opening. As used herein, the term "mixing feature" includes, but is not limited to, chambers, reservoirs, conduits, channels, and combinations thereof.

"Optional" or "optionally" as used herein means that the subsequently described feature or structure may or may not be present, or that the subsequently described event or circumstance may or may not occur, and that the description includes instances where a particular feature or structure is present and instances where the feature or structure is absent, or instances where the event or circumstance occurs and instances where it does not. Mere reference to a feature, structure, event or circumstance as "optional," does not imply in any way whether the feature, structure, event or circumstance is be preferred.

The term "substantially" as in "substantially identical in size" is used herein to refer to items that have the same or nearly the same dimensions such that corresponding dimensions of the items do not differ by more than approximately 15%. Preferably, the corresponding dimensions do not differ by more than 5% and optimally by not more than approximately 1%. For example, two openings are substantially identical in size when the openings exhibit dimensions within approximately 10% of each other. Other uses of the term "substantially" have an analogous meaning.

The term "symmetric" is used herein in its ordinary sense to refer to a correspondence on opposite sides of a line or plane or about a central point or an axis. Thus, for example, "symmetric motion" refers to the movement of an item in the same manner on opposite sides of a line or plane of symmetry or the movement of an item in the same manner relative to a central point or axis of symmetry. Similarly, "asymmetric motion" refers to the movement of an item in a different manner on opposite sides of a line or plane of symmetry or about a point or axis of symmetry. For example, when the position of a moving item is plotted against time, a sinusoidal, triangular, or square wave plot indicates symmetric movement, whereas a sawtooth wave plot indicates asymmetric movement.

The terms "vortex" and "vortices" are used herein in their ordinary sense and refer to a localized swirl of rotational fluidic movement.

The invention thus relates to an active fluid mixing device and method that involves allowing fluids to mix by flowing from a first mixing feature to an adjacent mixing feature and vice versa. This is accomplished by placing the mixing features in fluid communication with each other such that fluids contained therein contact each other through openings of the mixing features. When the mixing features are moved with respect to each other, the shear stresses are generated within the fluids, particularly at the mixing feature openings, as one fluid is "dragged" over another. As a result, fluid circulation occurs within the mixing features. Repeated movement of the mixing features tends to increase the level of mixing within the mixing features. In addition, the invention tends to enhance mixing in flow speed regimes associated with low Reynolds numbers (typically involving low flow rates and/or small mixing feature dimensions), as well as in other flow speed regimes associated with high Reynolds number.

The inventive device is comprised of a substrate and a cover plate each containing a mixing feature. Each mixing feature terminates at an opening located on a surface of the substrate or cover plate, respectively. Typically, the cover plate and substrate surface are substantially planar so that they form a fluid-tight seal with placed in slidable contact with each other. Also provided is a means for producing relative sliding motion between the cover plate and substrate surfaces. When the device is used to mix fluids, each mixing feature is filled with a fluid. Then, relative sliding motion is produced between the substrate and cover plate surfaces while the surfaces are maintained in fluid-tight contact with each other. As a result, the first and second fluids are mixed through the first and second openings.

The invention provides previously unknown advantages in microfluidic and other technologies because the mixing features may be incorporated into microdevice valve structures that employ slidable motion for actuation, e.g., valve structure that have a slidable fluid-tight interface. In such a case, the same region of a microdevice may be employed for both fluid mixing and flow control/switching. As a result, overall fluid volume needed for microdevice operability and "dead" volume in the microdevice are reduced, an advantage when fluids are rare, expensive, or difficult to obtain.

FIG. 1 depicts an example of the inventive device suitable for a microfluidic application wherein linear motion is employed to mix fluids. As with all figures referenced herein, in which like parts are referenced by like numerals, FIG. 1 is not necessarily to scale, and certain dimensions may be exaggerated for clarity of presentation. As shown in FIG. 1A, the microdevice 1 includes a substrate 10 having a contact surface indicated at 12. Typically, the contact surface 12 is substantially planar. Optionally, the substrate 10 may have a second substantially planar surface 14 in parallel and opposing relationship to the contact surface 12. However, the second surface 14 may be complex, nonplanar, and/or nonparallel to the contact surface 12. The substrate is comprised of a material that is substantially inert with respect to fluids that will be in contact with and/or transported through the microdevice. The substrate 10 has a mixing feature in the form of a microchannel 16 that terminates in a microchannel opening 18 in the first planar surface 12. The mixing feature may be formed through laser ablation or other techniques discussed below or known in the art.

As depicted, the microchannel 16 may have a substantially planar bottom profile, which is parallel to the profile of the contact surface 12. As discussed below, other bottom profiles may be advantageously employed as well. The microchannel 16 extends from an optional terminal inlet conduit 20 to an outlet terminus 22. The inlet conduit 20 traverses the thickness of the substrate 12 and extends from surface 12 to surface 14. In some embodiments, optional microalignment means in the form of projections 24 may be provided protruding from the contact surface 12. Together with the contact surface 12, the projections 24 form a trough 26 having parallel, planar and vertical sidewalls. The trough 26 serves to assist in the proper alignment of the cover plate 30 with the substrate 10. As depicted, the substrate inlet conduit 20 is located at a point in the trough 26 equidistant to the sidewalls, but the location of the conduit is not critical to the invention.

Like the substrate, a rectangular cover plate 30 is provided having a contact surface indicated at 32. Typically, the contact surface 32 is substantially planar. In addition, the cover plate 30 comprises a second surface 34 in opposing relationship to the contact surface 32. Optionally, the second surface 34 may be substantially parallel to the contact surface 32. As depicted, the width of the cover plate 30 may be the same as the width of the substrate trough 26. Located on the contact surface 32 is a mixing feature also in the shape of a microchannel 36 that terminates in a microchannel opening 38 in the contact surface 32. As depicted, the microchannel 36 may have a shape that is identical to the microchannel 16 of the substrate. In other embodiments, however, the substrate and cover plate mixing features may have different or similar, but nonidentical, shapes. As depicted, the cover plate microchannel 36 extends from an optional inlet conduit 40 to an optional outlet conduit 42, each conduit traversing the thickness of the cover plate 30 and extending from surface 32 to surface 34.

The cover plate 30 can be formed from any suitable material for forming substrate 10. For example, the cover plate 30 and the substrate 10 may be formed from the same or different materials. In addition, the contact surface 32 of the cover plate 30 is capable of interfacing closely with surface 12 of the substrate 10 to result in fluid-tight contact. Thus, the cover plate 30 is arranged over the substrate contact surface 12 such that microchannel openings 18 and 38 are aligned. When optional projections 24 are employed, they allow the cover plate to be slide along the trough but prohibits sliding motion across the trough. To ensure that the contact surfaces 12 and 32 are in fluid-tight relationship, pressure-sealing techniques may be employed, e.g., by using external means to urge the pieces together (such as clips, springs, pneumatic or hydraulic means, or associated clamping apparatus). However, excessive pressure that precludes the substrate and cover plate contact surface from slidable contact should be avoided. The optimal pressure can be determined through routine experimentation.

Figure 1B:
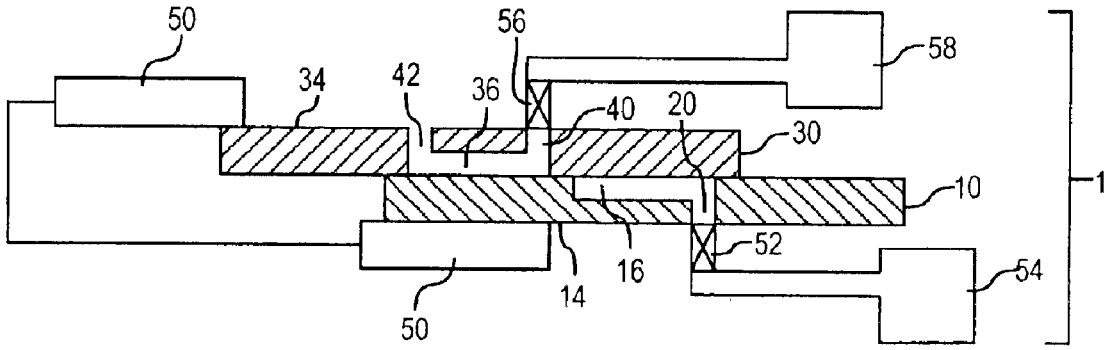
Figure 1C:
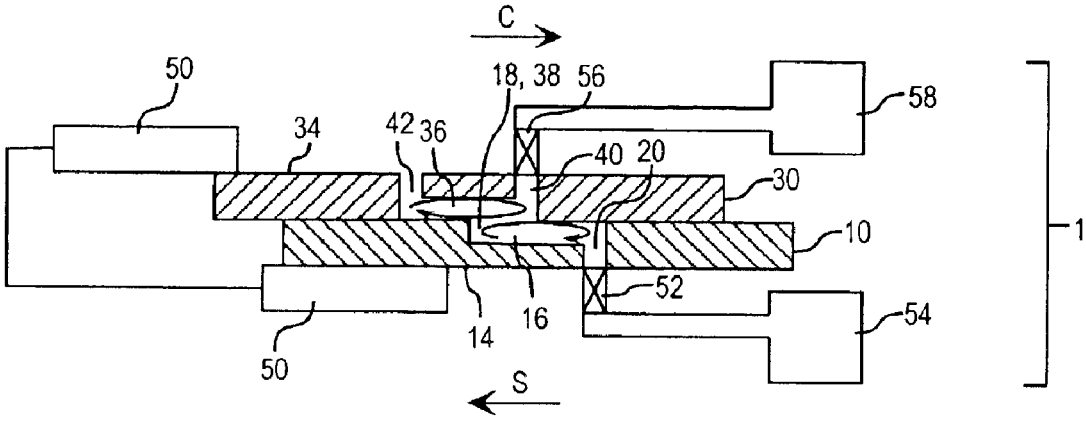
Figure 1D:
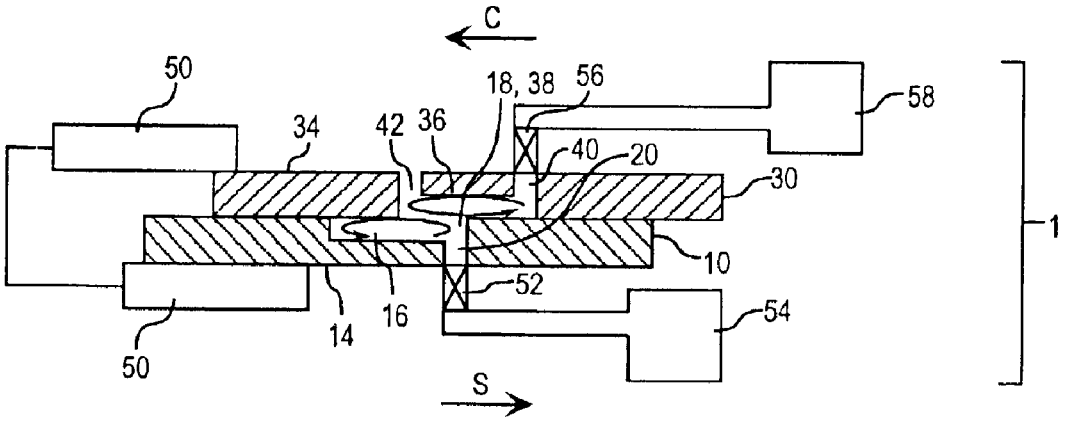

FIGS. 1B–1D depict the inventive device in schematic cross-sectional views along the plane perpendicular to surfaces 12, 14, 32, and 34, the plane indicated by dotted line A. As shown, conduit 20 extends through the substrate in a direction orthogonal to surfaces 12 and 14, and conduits 40 and 42 extend through the substrate in a direction orthogonal to surface 32 and 34. In addition, conduits 20, 40 and 42 each may have substantially constant cross-sectional area along their length. The cross sectional area of the conduits may correspond to the size and shape the microchannel to which they interface. A means for producing relative sliding motion 50 between the cover plate and substrate surfaces may also be provided. As depicted in FIGS. 1B–1D, such means may optionally engage the substrate 10 and cover plate 30, at surfaces 14 and 34, respectively.

In operation, as depicted in FIG. 1B, mixing microchannels 16 and 36 are filled with first and second fluids from external fluid sources. Valve 52 is opened so as to provide a flow path that allows a motive force to drive the first fluid so that the first fluid travels successively from the first fluid source 54, through valve 52, through inlet conduit 20 and into mixing microchannel 16. Similarly, valve 56 is opened so as to provide a flow path that allows the second fluid to be driven successively from the second fluid source 58, through valve 56, through inlet conduit 40 and into mixing microchannel 36. Typically, the valves 52 and 56 are positioned in close proximity to the inlets 20 and 40, respectfully, so as to minimize the dead volume therebetween. In order to ensure that no trapped fluid (e.g., gas) hinders the filling of the mixing microchannels, means for ventilating the mixing features may be provided. For example, the outlet conduit 42 may serve as such a ventilating means for the cover plate mixing microchannel 36.

It should be noted that the term "successively" as used herein refer to a sequence of events. For example, when a fluid travels "successively" through a valve and into a mixing conduit, the fluid travels through the valve before traveling into the mixing conduit. "Successively" does not necessarily mean consecutively. For example, a fluid traveling successively through a valve and into a mixing conduit does not preclude the fluid from traveling through an inlet conduit after traveling through the valve and before traveling into the mixing conduit. Thus, flow paths that include additional elements, e.g., capillaries, tubing, filters, etc., are not precluded from the invention even if not specifically depicted or described.

Once mixing microchannels are filled with appropriate fluids, valves 52 and 56 may be shut to isolate the mixing microchannels 16 and 36 from the fluid sources 54 and 58, respectively. Then, sliding means 50 provide relative sliding motion between the substrate 10 and cover plate 30, while the substrate surface 12 and cover plate surface 32 are maintained in fluid-tight contact with each other. As depicted in FIG. 1C, the substrate 10 and the cover plate 30 are moved toward each other in the directions indicated by corresponding arrows S and C. Although both the substrate and cover plate are depicted in motion, one of ordinary skill in the art will recognize that either one of the substrate and the cover plate may be moved to provide relative motion between the substrate and the cover plate. As a result of the relative motion, mixing microchannel opening 18 and 38 successively approach, overlap, travel past each other. When the mixing microchannel openings overlap each other, fluid communication is provided between mixing microchannels 16 and 36. In addition, the relative motion between the mixing microchannels generate shear forces in the fluids in the mixing microchannels 16 and 36. Fluid may also move from one mixing microchannel through the mixing microchannel openings and into the other. In addition, fluid within each mixing microchannel may circulate in the direction indicated by curved arrows F in FIG. 1C.

In order to effect further mixing, the sliding means 50 may again provide relative sliding motion between the substrate 10 and cover plate 30. As depicted in FIG. 1D, the substrate 10 and the cover plate 30 are moved toward each other in the directions indicated by corresponding arrows S and C, which are reversed from that depicted in FIG. 1C. As a result, the reversed relative motion between the mixing microchannels will again generate shear forces to mix and circulate fluids within the mixing microchannels. By repeatedly moving the mixing microchannels relative to each other, thorough mixing of the fluids in the mixing channels may be achieved. Once a desired degree of fluid mixing is effected, a motive force may be provided to expel the mixed fluid from the device via outlet conduit 42. Although FIG. 1 depicts a device having a single outlet design, additional outlets may optionally be provided as well. In some instances, an inlet may also serve as an outlet, though not simultaneously.

Alternatively, the invention may be used in continuous fluid mixing mode. In this mixing mode, a continuous flow of fluids is provided through at least one of the substrate and cover plate mixing features, while relative sliding motion is provided between the mixing features. In the context of the device depicted in FIG. 1, valves 52 and 56 may remain open so as to allow a motive force to provide continuous fluid flow through the device while the substrate mixing channel 16 and cover plate mixing channel 36 are slid relative to each other. As a result, mixed fluid will emerge from outlet conduit 42, while mixing is carried out. One of ordinary skill in the art will recognize that continuous mixing may be carried out either with or without valves.

In general, the mixing features are constructed to control and/or enhance the mixing rate associated with the invention. For microfluidic applications, at least one mixing feature typically has a volume that is at least about 1 pL but less than or equal to about 100 $\mu$L. In addition, the mixing features are typically shaped to enhance the circulation of the fluids within each mixing feature and/or enhance the exchange of fluids between the mixing features. While FIG. 1 depicts an example of the inventive device having mixing features in the form of a microchannel, other mixing features types, shapes, and configurations may be used as well.

Figure 2A:
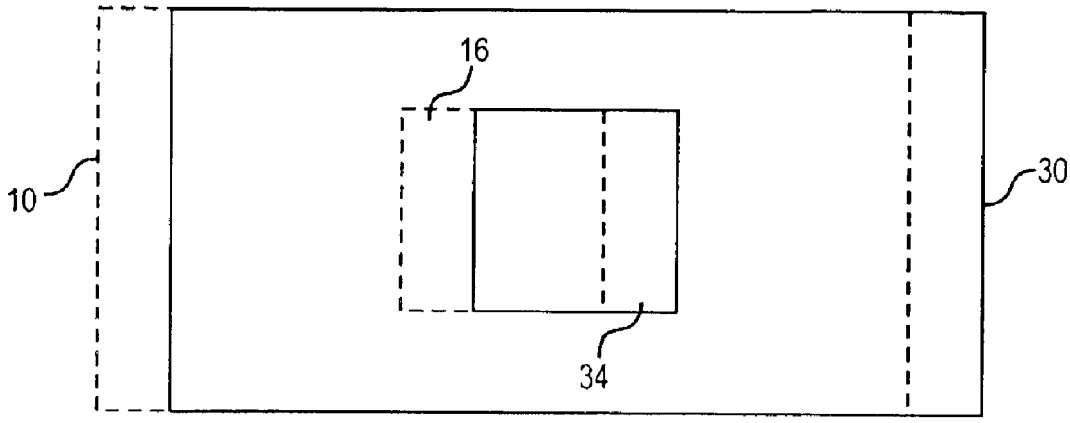
FIGS. 2A and 2B, collectively referred to as FIG. 2, schematically illustrate an exemplary inventive microdevice similar to that depicted in FIG. 1, but having wider and shallower mixing features.
Figure 2B:
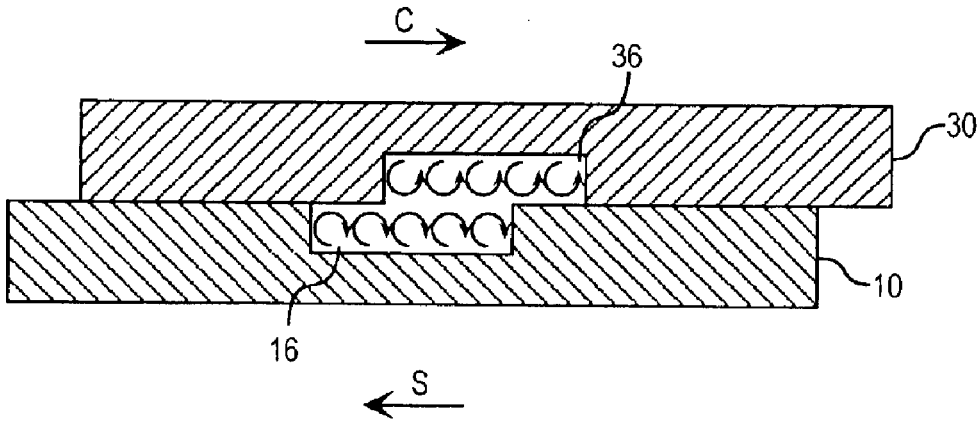

FIG. 2 depicts another exemplary device of the invention similar to that depicted in FIG. 1 but having different mixing feature geometries. Provided are a substrate 10 and cover plate 30 in fluid-tight contact with each other. FIG. 2A illustrates the microdevice in top through view, wherein the solid lines indicate features associated with the cover plate 30, and dotted lines indicate features associated with the substrate 10. FIG. 2B illustrates the microdevice in cross-sectional view. Unlike the mixing microchannels of the device of FIG. 1, the mixing microchannels 16 and 36, associated with the substrate 10 and cover plate 30, respectively, are wider, longer, and shallower. The substrate 10 and cover plate 30 are moved toward each other in the directions indicated by corresponding arrows S and C, and the mixing microchannels 16 and 36 successively approach, overlap, and travel past each other. As a result of the relative sliding motion and the geometry of the mixing microchannels 16 and 36, a plurality of fluid vortices as indicated by curved arrows F is generated within each microchannel.

Figure 3A:
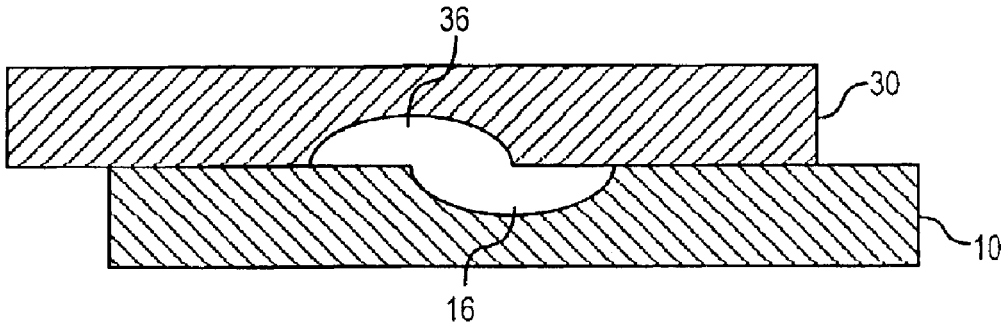
FIGS. 3A–3C, collectively referred to as FIG. 3, depict in cross-sectional schematic views of various examples of devices having mixing features that exhibit a substantially nonplanar bottom profile.
Figure 3B:
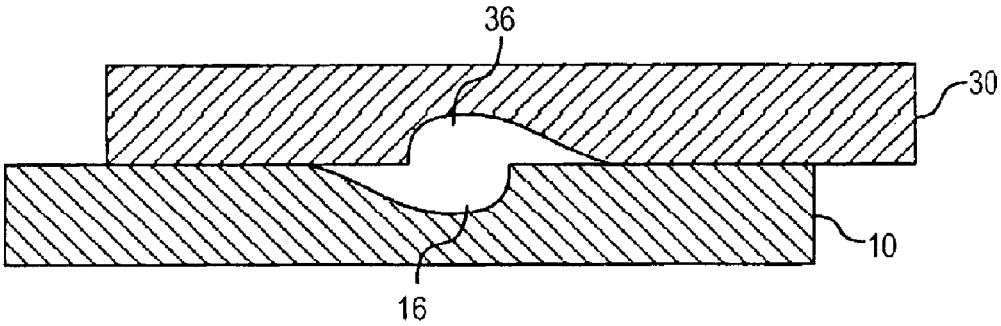
Figure 3C:
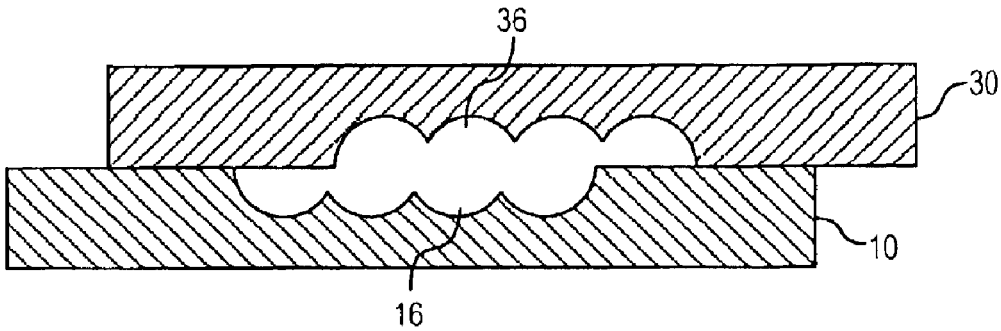

Devices having at least one mixing feature with a substantially nonplanar bottom profile may be employed as well. FIG. 3 illustrates, in cross-sectional schematic view, various examples of devices similar to those depicted in FIGS. 1 and 2, except with mixing features having a substantially nonplanar bottom profile. FIG. 3A depicts a device having mixing features with a round bottom profile. Such a bottom profile generally produces a single smooth vortex. FIG. 3B depicts a device having mixing features with a curved bottom profile. Vortices produced using such bottom profile generally differ depending on the direction of relative movement between the cover plate and the substrate. FIG. 3C depicts a device having mixing features shaped to create a plurality of vortices at specific locations in the mixing features.

Figure 4A:
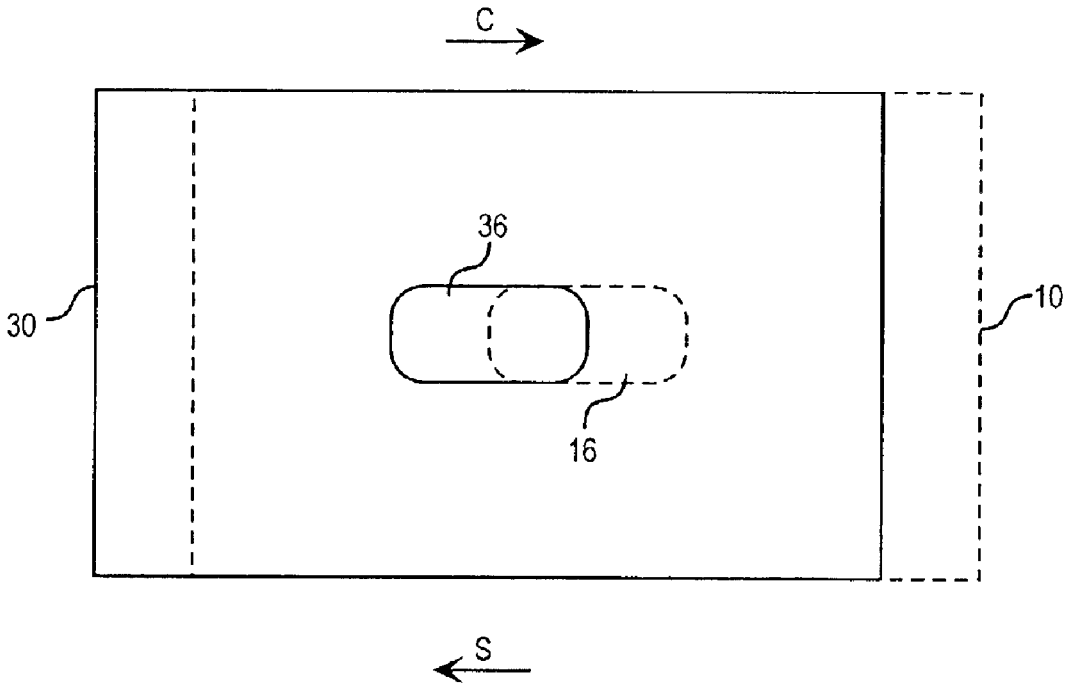
FIGS. 4A–4F, collectively referred to as FIG. 4, depicts in top through view of six microdevices having mixing features with varied terminal opening sizes, shapes and alignments.
Figure 4B:
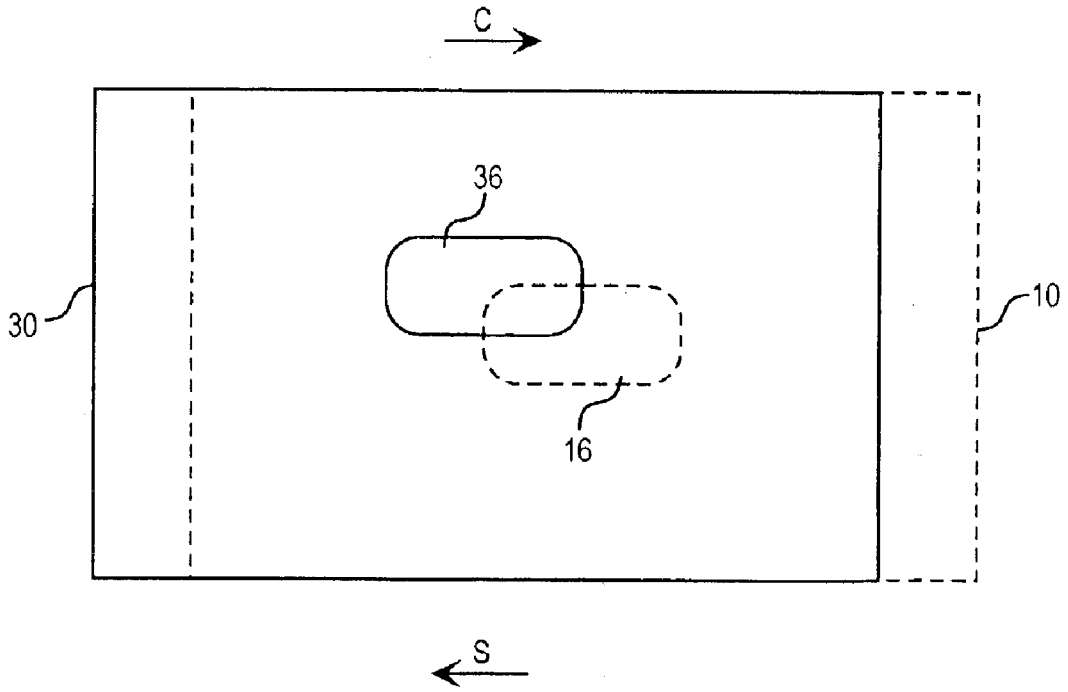

Depending on the desired mixing performance, the substrate and the cover plate of the inventive device may be arranged to control the mixing action associated with the relative sliding motion of the mixing features. More specifically, the mixing features may be arranged to control mixing action. FIG. 4 depicts, in top through view, six microdevices 1, each comprising a substrate 10 and a cover plate 30 in linearly slidable relationship with respect to each other, wherein the solid lines indicate features associated with the cover plate 30, dotted lines indicate features associated with the substrate 10, and arrows C and S indicate directions toward which the cover plate 30 and the substrate 10 may move, respectively. FIG. 4A depicts an exemplary microdevice in which the terminal openings of the mixing features 16 and 36 are identical in size and shape. In addition, the openings of the mixing features may be moved transversely so as to coincide with and completely overlap each other. FIG. 4B depicts an exemplary microdevice in which the terminal openings of the mixing features 16 and 36 are identical in size and shape, but are offset from each other. As a result, each mixing feature is depicted having a shaded nonoverlapping portion with respect to the other.

Figure 4C:
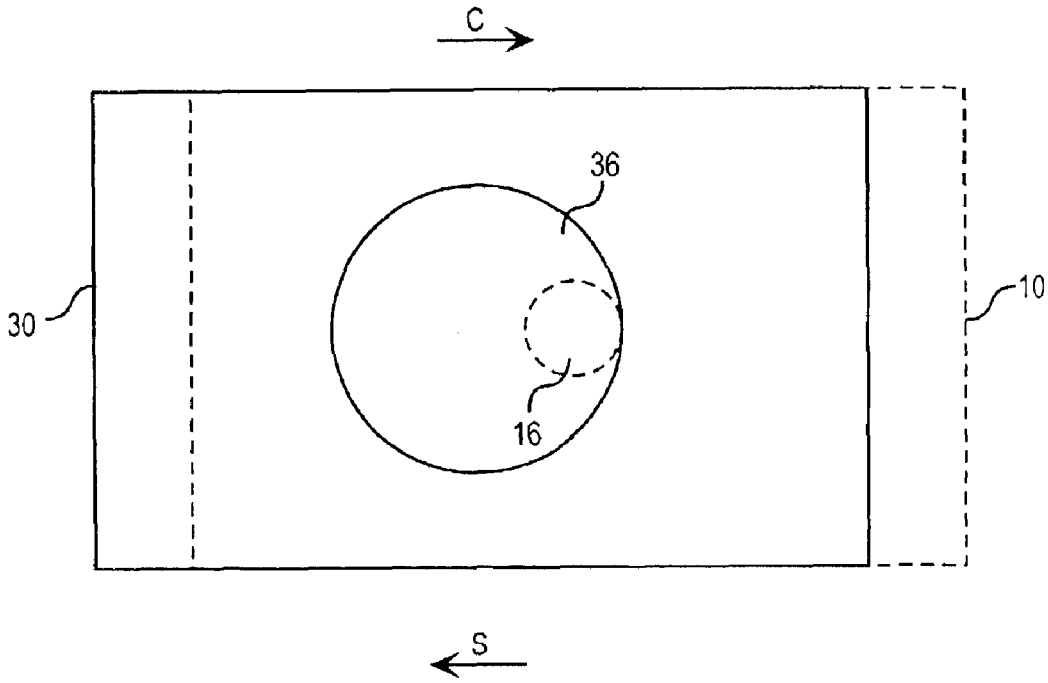
Figure 4D:
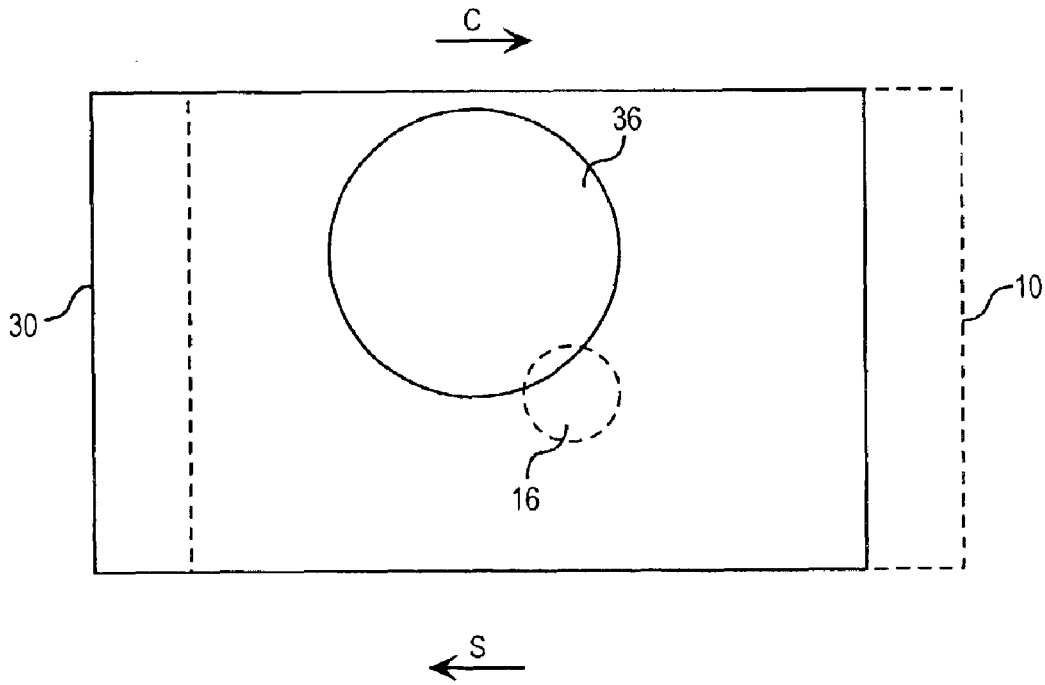
Figure 4E:
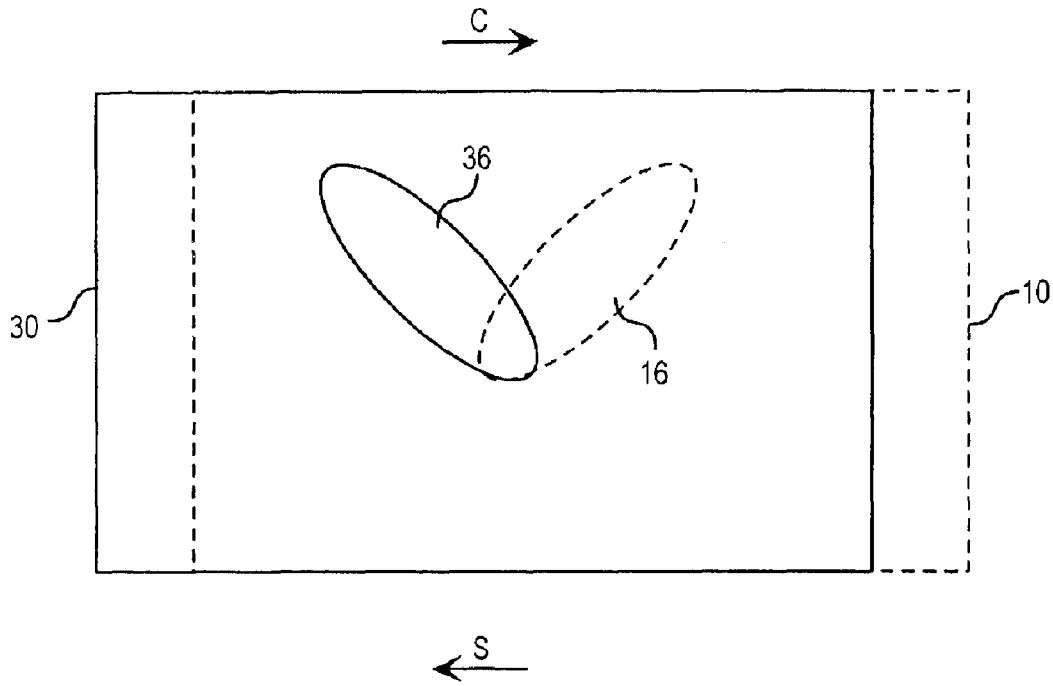
Figure 4F:
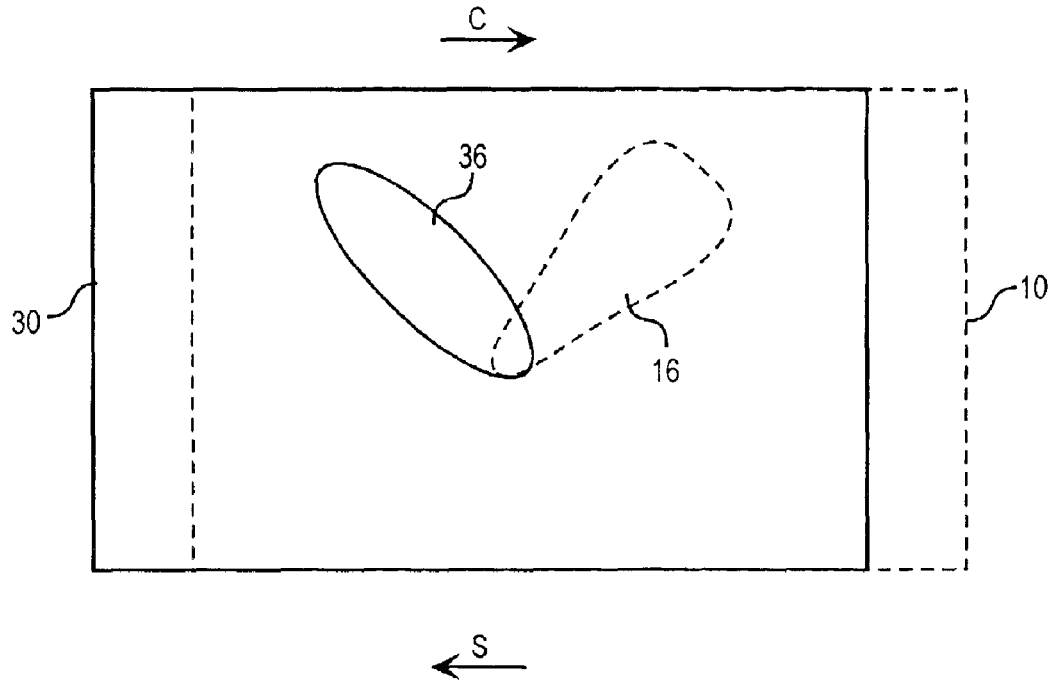

FIG. 4C depicts an exemplary microdevice in which the terminal openings of the mixing features 16 and 36 are different in size and shape. As depicted, mixing feature 36 entirely covers the mixing feature 16, yet has a shaded nonoverlapping portion. FIG. 4D depicts an exemplary microdevice in which the terminal openings of the mixing features 16 and 36 are different in size and shape, and are offset from each other. As depicted, the mixing features 16 and 36 are slidably movable in an offset manner with respect to each other such that each has a shaded nonoverlapping portion. An offset configuration may be advantageously used for mixing fluids by exploiting asymmetric fluid movement generated as a result of relative movement between mixing features. FIG. 4E depicts an exemplary microdevice in which the terminal openings of the mixing features 16 and 36 are identical in size and shape but are oriented differently. As a result, only a portion of the mixing features may overlap each other at a time. As depicted, the area of overlap remains substantially the same. FIG. 4F depicts a variation of the device illustrated in FIG. 4E in that only of portion of the mixing features 16 and 36 may overlap each other at a time. However, the area of overlap changes depending on the relative positions of the substrate 10 and cover plate 30.

It will be readily appreciated that although the mixing features have been represented in a regular form, mixing features of the inventive device have a variety of shapes. For example, when a mixing feature is provided as a microchannel, the microchannel may exhibit a straight, serpentine, spiral, or any other path desired. Further, the mixing feature openings can be formed in a wide variety of geometries including semi-circular, rectangular, rhomboid, and the like, and be formed in a wide range of aspect ratios. Similarly, inlet and outlets associated with the mixing features may be provided as conduits, channels and other fluid-transporting features that direct fluid flow.

Figure 5:
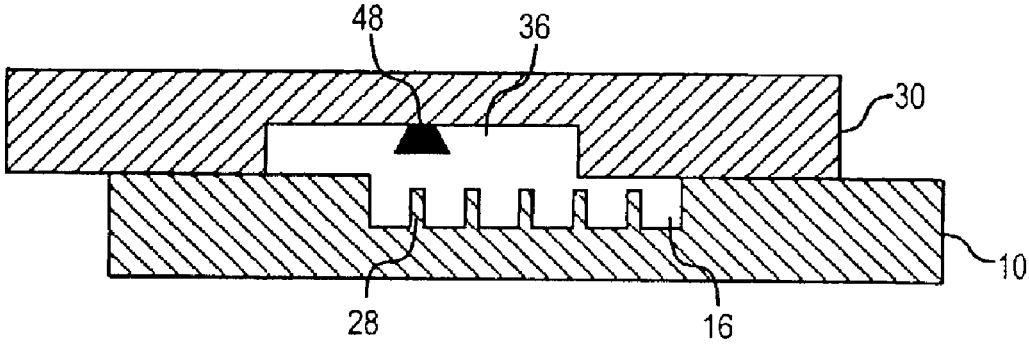
FIG. 5 schematically depicts, in cross sectional view, a microdevice having a plurality of flow disturbance features.

In some embodiments, one or more flow disturbance features may be included in a mixing feature. The shape, size, orientation, and other geometric aspects of the flow disturbance feature may be selected according to the desired mixing performance. In addition, the flow disturbance features in any mixing feature may be an integral to, attached to, detachable from, or unconnected from the mixing feature. For example, FIG. 5 depicts a microdevice 1 similar to that depicted in FIG. 1 except that a plurality of substrate flow disturbance features 28 and a single cover plate flow disturbance feature 48 are provided. As shown, the substrate flow disturbance features 28 are located within substrate mixing feature 16 and represent an integral part of the substrate 10. In contrast, the cover plate flow disturbance feature 48 is provided in the form of a bar attached to the bottom of cover plate mixing feature 36. While the cover plate and substrate flow disturbance features are not depicted as extending past the mixing feature openings, flow disturbance features may alternatively be provided such that they extend from one mixing feature into another mixing feature to provide additional mixing capability in alternative embodiments. In such cases, the flow disturbance feature may be plastically or elastically deformable to avoid hindering relative sliding movement of the mixing features.

Thus, one of ordinary skill in the art will recognize that flow disturbance features and the bottom profile of the mixing features serve related but distinct purposes in the context of the present invention. When a mixing feature having nonplanar bottom profile is employed, mixing is primarily enhanced within the mixing feature exhibiting the nonplanar bottom profile. In contrast, when a flow disturbance feature is provided in a first mixing feature in relative sliding motion with respect to a second mixing feature, the flow disturbance feature primarily enhances mixing within the second mixing feature. However, it should be noted that secondary fluid mixing effects may result as well. That is, any enhancement of fluid mixing within a mixing feature will tend result in enhanced mixing within another mixing feature in fluid communication therewith.

Figure 6A:
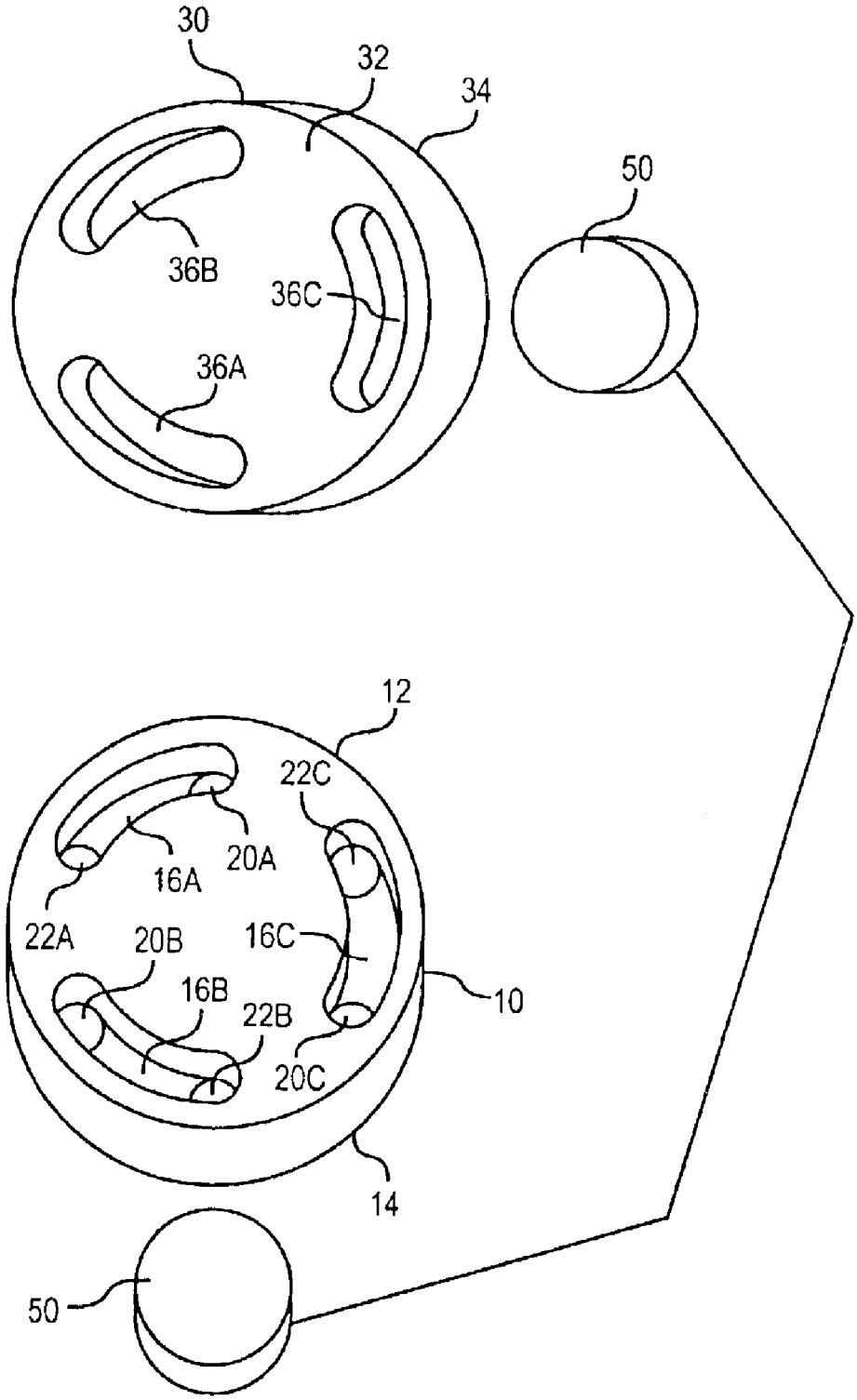
FIGS. 6A–6F collectively referred to as FIG. 6, schematically illustrate an exemplary inventive microdevice that employs rotational motion to effect fluid switching and/or mixing.

The substrate and the cover plate may each contain a single mixing feature or a plurality of mixing features. In some instances, the substrate and the cover plate may each contain the same number of mixing features. In other instances, the substrate and the cover plate may contain different numbers of mixing features. For example, FIG. 6 depicts an example of the inventive device wherein rotational motion is employed to mix fluids within a plurality of mixing feature pairs. The depicted device is similar to the rotor-stator valve technology described in U.S. Patent Application Publication No. 2003/0017609 to Yin et al., and may be used as a valve in various microfluidic applications. As shown in FIG. 6A, the microdevice 1 includes a general substrate 10 having opposing surfaces indicated at 12 and 14 respectively. The substrate 10 has three mixing features in the form of curved microchannels, indicated at 16A, 16B, and 16C, each terminating in an opening in the first planar surface 12. Each microchannel 16A, 16B, and 16C, extends from a corresponding inlet conduit, indicated at 20A, 20B, and 20C, respectively, to a corresponding outlet conduit, indicated at 22A, 22B, and 22C, respectively. The conduits extend through surface 14. When the device 1 is used as a valve, the substrate 10 may be referred to as a "stator."

A circular cover plate 30 is provided also comprising first and second substantially opposing surfaces indicated at 32 and 34, respectively. The cover plate may also be referred to as a "rotor." Located on the contact surface 32 are three curved mixing microchannel 36A, 36B, and 36C, each terminating in an opening in the contact surface 32. As a result, the cover plate contact surface 32 effectively mirrors the substrate contact surface 12. Also depicted in FIG. 6A is a means for producing relative sliding motion between the cover plate and substrate surfaces in the form of rotators 50 adapted to operatively engage the substrate 10 and cover plate 30, at surfaces 14 and 34, respectively. Upon the engagement of rotators 50 to the substrate 10 and cover plate 30, the cover plate contact surface 32 is arranged over the substrate contact surface 12 to ensure that the contact surfaces 12 and 32 are placed in rotationally slidable and fluid-tight contact with each other and such that the openings are aligned as desired. Optionally, microalignment means (not shown) may be used to ensure that the cover plate and the substrate move in proper alignment.

Figure 6B:
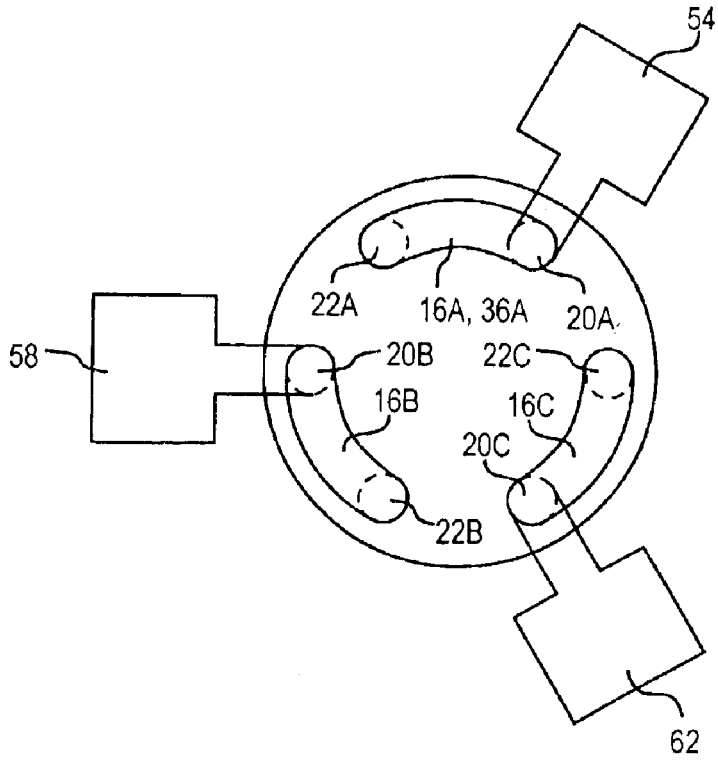
Figure 6C:
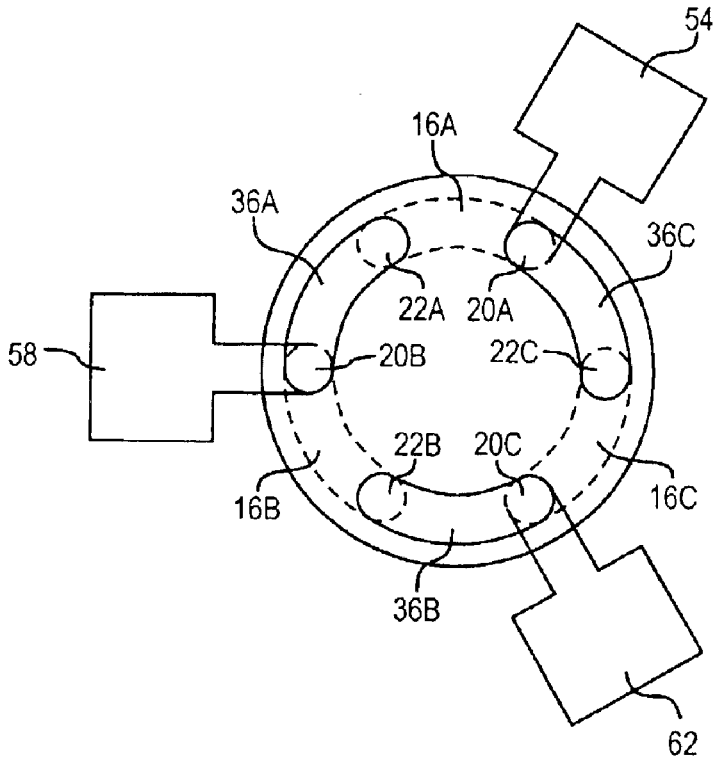

FIGS. 6B–6F schematically depicts the inventive device in top through view, wherein the solid lines indicate features associated with the cover plate 30 and dotted lines indicate features associated with the substrate 10. FIG. 6B depicts a configuration of the device in which the substrate mixing microchannels 16A, 16B, and 16C are aligned with cover plate mixing channels 36A, 36B, and 36C, respectively. In such a configuration, only the aligned microchannels fluidly communicate each other. No fluid communication is provided between any two substrate mixing microchannels. Similarly, none of the mixing microchannels in the cover plate are in fluid communication with each other. In contrast, when the cover plate 30 is rotated approximately 60° from the substrate 10, as depicted in FIG. 6C, all mixing microchannels 16A, 16B, 16C, 36A, 36B, and 36C fluidly communicate with each other. Accordingly, FIGS. 6B and 6C illustrates an exemplary valving and/or flow switching application associated with the inventive device.

In operation, the inventive device may be provided in the configuration depicted in FIG. 6B. In addition, inlet conduits 20A, 20B, and 20C may be provided in fluid communication with first fluid source 54, second fluid source 58 and third fluid source 62, respectively. Under an appropriate motive force, mixing features 16A and 36A may be filled with a first fluid. Similarly, mixing features 16B and 36B may be filled with a second fluid, and mixing features 16C and 36C may be filled with a third fluid.

Figure 6D:
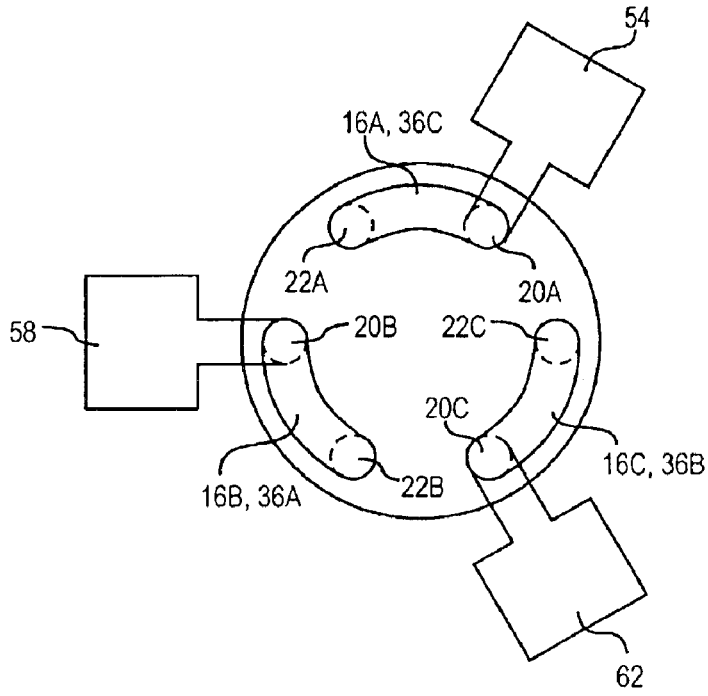
Figure 6E:
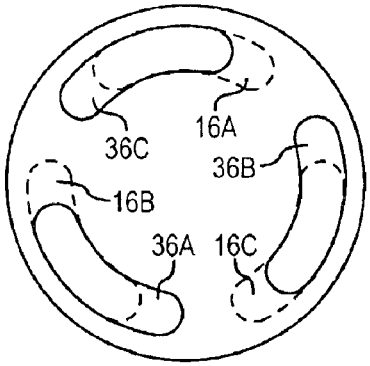
Figure 6F:
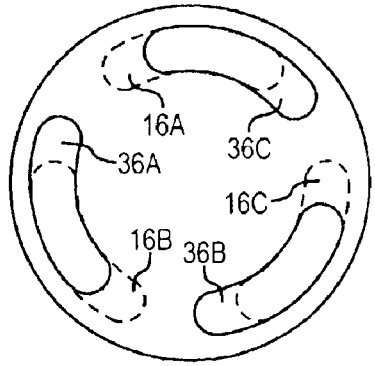

When the cover plate 30 is rotated approximately 120° with respect to the substrate 10, as depicted in FIG. 6D, the substrate mixing microchannel 16A becomes aligned with cover plate mixing microchannel 36C. Similarly, microchannel 16B becomes aligned with cover plate mixing microchannel 36A, and microchannel 16C becomes aligned with cover plate mixing microchannel 36B. By providing oscillating rotational sliding movement between the substrate 10 and cover plate 30 in the manner depicted in FIGS. 6E and 6F, shear forces will be generated within the fluids in the microchannels. As a result, the first and second fluids will be mixed in microchannels 16A and 36B, the second and third fluids will be mixed in microchannels 16B and 36C, and the first and third fluids will be mixed in microchannels 16C and 36A.

Thus, depending on the construction of the inventive, a number of means are suitable for producing relative sliding motion between the cover plate and substrate surfaces. In some embodiments, the means for producing relative sliding motion rotates the surfaces of the substrate and cover plate relative to each other. In other embodiments, relative linear movement results between the surfaces of the substrate and cover plate. In some instances, two-dimensional motion (e.g., X-Y motion) may be accomplished through a combination of linear and/or rotational movements. For example, sliding means and rotators as described above may be employed to effect linear and rotational sliding motion, respectively. In addition, such means for producing relative sliding motion may be constructed from, for example, motors, levers, pulleys, gears, hydraulics, pneumatics, a combination thereof, or other electromechanical or mechanical means known to one of ordinary skill in the art.

In some embodiments, the means for producing relative sliding motion produces periodic motion between the substrate and cover plate surfaces. Periodic motion may be selected to enhance fluid mixing within the mixing features. Typically, the periodic motion has a frequency of at least about 0.10 Hz but less than or equal to about 1000 Hz. At lower frequencies, mixing may not be sufficiently enhanced for certain applications. Preferably, the periodic motion has a frequency of about 1 Hz to about 100 Hz.

In addition, the periodic motion between the cover plate and the substrate may be symmetric. Symmetric periodic motion will sometimes cause fluid flow in each mixing chamber to reverse itself during the second half of any oscillating cycle. Changing the speed of actuation according to the actuation direction may result in improved mixing. Thus, asymmetric motion between the cover plate and substrate is typically preferred over symmetric motion, particularly in combination with shaped mixing features having a nonplanar bottom profile such as those depicted in FIG. 3.

The materials used to form the substrates and cover plates in the devices of the invention as described above are selected with regard to physical and chemical characteristics that are desirable for proper functioning of the device. In microfluidic applications, the substrate and cover plate are typically fabricated from a material that enables formation of high definition (or high "resolution") features, e.g., microchannels, chambers, mixing features, and the like, that are of micron or submicron dimensions. That is, the material should be capable of microfabrication using, e.g., dry etching, wet etching, laser etching, laser ablation, molding, embossing, or the like, so as to have desired miniaturized surface features; preferably, the substrate is capable of being microfabricated in such a manner as to form features in, on and/or through the surface of the substrate. Microstructures can also be formed on the surface of a substrate by adding material thereto, for example, polymer channels can be formed on the surface of a glass substrate using photoimageable polyimide. Also, all device materials used are preferably chemically inert and physically stable with respect to any substance with which they come into contact when used to introduce a fluid (e.g., with respect to pH, electric fields, etc.). Suitable materials for forming the present devices include, but are not limited to, polymeric materials, ceramics (including aluminum oxide, silicon oxide, zirconium oxide, and the like), semiconductors (including silicon, gallium arsenide, and the like) glass, metals, composites, and laminates thereof.

Polymeric materials suitable for use with the invention are typically organic polymers. Such polymers may be homopolymers or copolymers, naturally occurring or synthetic, crosslinked or uncrosslinked. Specific polymers of interest include, but are not limited to, polyimides, polycarbonates, polyesters, polyamides, polyethers, polyurethanes, polyfluorocarbons, polystyrenes, poly (acrylonitrile-butadiene-styrene)(ABS), acrylate and acrylic acid polymers such as polymethyl methacrylate, and other substituted and unsubstituted polyolefins, and copolymers thereof. Generally, at least one of the substrate or cover plate comprises a biofouling-resistant polymer when the microdevice is employed to transport biological fluids. Polyimide is of particular interest and has proven to be a highly desirable substrate material in a number of contexts. Polyimides are commercially available, e.g., under the tradename Kapton®, (DuPont, Wilmington, Del.) and Upilex® (Ube Industries, Ltd., Japan). Polyetheretherketones (PEEK) also exhibit desirable biofouling resistant properties.

The devices of the invention may also be fabricated from a "composite," i.e., a composition comprised of unlike materials. The composite may be a block composite, e.g., an A-B-A block composite, an A-B-C block composite, or the like. Alternatively, the composite may be a heterogeneous combination of materials, i.e., in which the materials are distinct from separate phases, or a homogeneous combination of unlike materials. As used herein, the term "composite" is used to include a "laminate" composite. A "laminate" refers to a composite material formed from several different bonded layers of identical or different materials. Other preferred composite substrates include polymer laminates, polymer-metal laminates, e.g., polymer coated with copper, a ceramic-in-metal or a polymer-in-metal composite. One preferred composite material is a polyimide laminate formed from a first layer of polyimide such as Kapton®, that has been co-extruded with a second, thin layer of a thermal adhesive form of polyimide known as KJ®, also available from DuPont (Wilmington, Del.).

In some instances, the cover plate and substrate may be made from the same material. Alternatively, different materials may be employed. For example, in some embodiments the cover plate may be comprised of a ceramic material and the substrate may be comprised of a polymeric material.

The devices can be fabricated using any convenient method. In particular, microdevices of the invention may be formed using techniques including, but not limited to, micromolding and casting techniques, embossing methods, and micromachining. Micromachining may be classified in two categories, bulk micromachining and surface micromachining. Bulk micromachining involves formation of microstructures by etching directly into a bulk material, typically using wet chemical etching or reactive ion etching ("RIE"). Surface micro-machining involves fabrication from films deposited on the surface of a substrate using methods such as sputtering, evaporation, LPCVD, PECVD, gas-phase polymer deposition, spin-on materials, casting, and the like.

A preferred technique for preparing the present microdevices is laser ablation. In laser ablation, short pulses of intense ultraviolet light are absorbed in a thin surface layer of material. Preferred pulse energies are greater than about 100 millijoules per square centimeter and pulse durations are shorter than about 1 microsecond. Under these conditions, the intense ultraviolet light photo-dissociates the chemical bonds in the substrate surface. The absorbed ultraviolet energy is concentrated in such a small volume of material that it rapidly heats the dissociated fragments and ejects them away from the substrate surface. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micron or less. Laser ablation will typically involve use of a high-energy photon laser such as an excimer laser of the $F_2$, ArF, KrCl, KrF, or XeCl type or of solid Nd-YAG or Ti:sapphire types. However, other ultraviolet light sources with substantially the same optical wavelengths and energy densities may be used as well. Laser ablation techniques are described, for example, by Znotins et al. (1987) *Laser Focus Electro Optics*, at pp. 54–70, and in U.S. Pat. Nos. 5,291,226 and 5,305,015 to Schantz et al.

When the device is formed for microfluidic applications, the microfabrication technique that is used should provide for features of sufficiently high definition, i.e., microscale components, channels, chambers, etc., such that precise alignment "microalignment" of these features is possible, i.e., the laser-ablated features are precisely and accurately aligned, including, e.g., the alignment of complementary microchannels with each other, projections and mating depressions, grooves and mating ridges, and the like.

From the above description of the various embodiments of the invention, it is evident that the invention provides a number of advantages over previously known devices and methods for mixing fluids. For example, the invention is particularly suited for use with known valve structures that employ a slidable motion for actuation. It should also be evident that the invention may be incorporated into any fluid handing device, in particular microdevices for carrying out chemical or biochemical reactions and processes for sample preparation and analysis. For example, the invention may be employed with a detector that represents a component of a mass spectrometer or that is adapted to detect fluorescence. In addition, the invention is particularly useful for use with a separation unit. The separation unit may be an integral part of the microdevice or detachable from the microdevice. For example, the separation unit may be constructed to carry out chromatography.

Variations of the present invention will be apparent to those of ordinary skill in the art. For example, additional substrates, cover plates and/or features may be included in stacked or other spatial arrangements. In addition, inlets and outlets for the mixing features may be formed from conduits and channels that provide for fluid flow in parallel or a nonparallel direction with respect to the contact surfaces. The inventive valve structure may provide fluid communication to features on the same substrate or different substrates that would otherwise be isolated. In other instances, rotationally slidable valve structures may be formed as concentric bodies. Moreover, additional substrates of a variety of shapes may be employed. Locking mechanisms may be provided to obtain a greater degree of control over the position of the contact surfaces. Particularly when the substrate and/or cover plate is formed from a hard material such as glass or silicon, a compliant sealing material or grease may be placed between the substrate and the cover plate. In addition or in the alternative, one of the substrate and the cover plate may be made from a softer material than the other. For example, the cover plate may be comprised of a softer material, e.g., a plastic material, when a relatively hard material, e.g., a ceramic material, is employed for a substrate.

It is to be understood that while the invention has been described in conjunction with the preferred specific embodiments thereof, the foregoing description is intended to illustrate and not limit the scope of the invention. Other aspects, advantages and modifications within the scope of the invention will be apparent to those skilled in the art to which the invention pertains.

All patents, patent applications, and publications mentioned herein are hereby incorporated by reference in their entireties.

We claim:

1. A device for mixing fluids, comprising:

a substrate containing a first mixing feature that terminates at a first opening located on a surface of the substrate;

a cover plate containing a second mixing feature that terminates at a second opening located on a surface of the cover plate; and a means for producing relative sliding motion between the cover plate and substrate surfaces, wherein the substrate and cover plate surfaces are maintained in fluid-tight contact with each other such that relative sliding motion between the first and second mixing features induces fluid mixing through the first and second openings when fluid is present in the mixing features.

2. The device of claim 1, wherein the cover plate and substrate surfaces are substantially planar.

3. The device of claim 2, wherein the first and second openings are substantially identical in size and/or shape.

4. The device of claim 2, wherein at least one opening has a nonoverlapping portion with respect to the other opening.

5. The device of claim 2, wherein at least one mixing feature has a substantially nonplanar bottom profile.

6. The device of claim 5, wherein the bottom profile is effective to generate a plurality of vortices within the feature when relative sliding motion is produced between the cover plate and substrate surfaces.

7. The device of claim 2, further comprising a flow disturbance feature located within at least one mixing feature.

8. The device of claim 7, wherein the flow disturbance feature does not extend past the opening of the mixing feature in which the flow disturbance feature is located.

9. The device of claim 8, wherein the flow disturbance feature is an integral part of the substrate or cover plate of the mixing feature in which the flow disturbance feature is located.

10. The device of claim 2, further comprising an inlet and outlet in fluid communication with at least one mixing feature.

11. The device of claim 2, wherein the means for producing relative sliding motion produces relative rotational movement between the surfaces of the substrate and cover plate.

12. The device of claim 2, wherein the means for producing relative sliding motion produces relative linear movement between the surfaces of the substrate and cover plate.

13. The device of claim 2, wherein the means for producing relative sliding motion produces periodic motion between the substrate and cover plate surfaces.

14. The device of claim 13, wherein the periodic motion has a frequency of at least about 0.10 Hz.

15. The device of claim 14, wherein the periodic motion has a frequency that is less than or equal to about 1000 Hz.

16. The device of claim 15, wherein the periodic motion has a frequency of about 1 Hz to about 100 Hz.

17. The device of claim 13, wherein the periodic motion is asymmetric.

18. The device of claim 2, wherein at least one mixing feature has a volume that is less than or equal to about 100 $\mu$L.

19. The device of claim 18, wherein the at least one mixing feature has a volume of at least about 1 pL.

20. A microdevice for mixing fluids, comprising:

a substrate containing a first mixing feature that terminates at a first opening on a surface of the substrate and is in fluid communication with a substrate inlet and an optional substrate outlet;

a cover plate containing a second mixing feature that terminates at a second opening on a surface of the cover plate and is in fluid communication with a cover plate inlet and a cover plate outlet; and a means for producing relative sliding motion between the substrate and cover plate surfaces, wherein the substrate and cover plate surfaces are maintained in fluid-tight contact with each other such that relative sliding motion between the first and second mixing features induces fluid mixing through the first and second feature openings when fluid is present in the mixing features, and at least one mixing feature has a volume less than or equal to about 100 $\mu$L.

21. A method for mixing fluids, comprising the steps of:

(a) filling a first mixing feature in a substrate with a first fluid, wherein the first mixing feature terminates at a first opening on a substrate surface;

(b) filling a second mixing feature in a cover plate with a second fluid, wherein the second feature terminates at a second opening on a cover plate surface; and (c) producing relative sliding motion between the substrate and cover plate surfaces while maintaining the surfaces in fluid-tight contact with each other to induce mixing of the first and second fluids through the first and second openings.

22. The method of claim 21, wherein step (c) is carried out simultaneously with step (a), step (b), or both.

23. The method of claim 21, further comprising step (d) removing mixed fluid from at least one of the first and second mixing features.

24. The method of claim 23, wherein step (d) is carried out simultaneously with step (c).

* * * * *